US007699197B2

(12) United States Patent
Panosian et al.

(10) Patent No.: US 7,699,197 B2
(45) Date of Patent: Apr. 20, 2010

(54) UTILITY BELT SYSTEM

(76) Inventors: Michael Panosian, 2425 Canada Blvd. #102, Glendale, CA (US) 91208; Paolo Kang, 267 N. Holliston #1, Pasadena, CA (US) 91106; Joshua M. Keeler, 1121 E. Chevy Chase Dr. #1, Glendale, CA (US) 91205; James Kendall Stobar, 946 Blue Mountain Cir., Westlake Village, CA (US) 91362

( * ) Notice: Subject to any disclaimer, the term of this patent is extended or adjusted under 35 U.S.C. 154(b) by 175 days.

(21) Appl. No.: 10/835,658

(22) Filed: Apr. 30, 2004

(65) Prior Publication Data

US 2005/0242144 A1 Nov. 3, 2005

(51) Int. Cl.
*A45F 3/04* (2006.01)
*A45F 5/00* (2006.01)

(52) U.S. Cl. ..... 224/665; 224/649; 224/271

(58) Field of Classification Search ..... 224/665, 224/663, 196, 271, 649, 651, 169, 197; D8/313
See application file for complete search history.

(56) References Cited

U.S. PATENT DOCUMENTS 4,747,527 A * 5/1988 Trumpower, II ..... 224/662
5,054,170 A * 10/1991 Otrusina ..... 24/580.11
5,839,173 A * 11/1998 Otrusina ..... 24/595.1
5,915,609 A * 6/1999 Diakoulas ..... 224/626
5,957,421 A * 9/1999 Barbour ..... 248/220.21
6,213,365 B1 * 4/2001 Stocke et al. ..... 224/665
6,273,872 B1 * 8/2001 Friedman ..... 604/174
6,520,863 B2 * 2/2003 Porper ..... 473/35
6,662,373 B2 * 12/2003 Frank ..... 2/94
6,698,632 B1 * 3/2004 Turner et al. ..... 224/196
2002/0096545 A1 * 7/2002 Chang ..... 224/271
2003/0141329 A1 * 7/2003 Huang ..... 224/197

* cited by examiner

*Primary Examiner*—Nathan J Newhouse
*Assistant Examiner*—Lester L Vanterpool
(74) *Attorney, Agent, or Firm*—Lackenbach Siegel LLP; Myron Greenspan

(57) ABSTRACT

A belt utility system for carrying up to a large number of objects includes an elongated flexible strap for removably supporting a large number of plurality of receptacles or holders for objects, at least one holder or receptacle for an object, as well as a way of removably attaching the receptacle(s) or holder(s) to the strap. This means of attachment includes a finger-gripping portion for facilitating both the simultaneous gripping of holder(s) or receptacle(s) for objects and the detachment, by the user, by generally lifting with the fingers, of these holder(s) or receptacle(s), in a generally upward direction. The utility system can also include a snap-lock connector connected to the strap and to the receptacle or holder, and a releasing tab or button near or on the gripping portion for releasing the connector portions from each other when pressed by the user's finger substantially at the same time as the user lifts the finger-gripping portion.

11 Claims, 13 Drawing Sheets

Framers Pouch
(a)
Carpenters Pouch
(b)
Mega Pouch
(c)
Electricians Pouch
(d)
Tape Pouch
(e)
First aid Pouch
(f)
Personal Pouch
(g)
Personal Pouch
(h)
Drink Pouch
(i)
Nail gun Pouch
(j)
Cable Pouch
(k)
Fastener Pouch
(l)
Fastener box Pouch
(m)
Pliers Pouch
(n)
Driver Pouch
(o)
Drill Pouch
(p)
Radio Pouch
(q)
Bit Pouch
(r)
Lunch box
(s)
Thermos
(t)
Small Pouch
(u)
Large Pouch
(v)
Shoulder harness
(w)

UTILITY BELT SYSTEM

BACKGROUND OF THE INVENTION

1. Field of the Invention

The invention generally relates to a utility belt system and, more specifically, to a convenient-to-use ergonomic modular/customizable system.

2. Description of the Prior Art

Tool bags and/or belt-supported pouches for carrying nails, screws, bolts and other tools are well-known in the industry. Typically, a "tool belt" is a belt having a number of pouches and/or tool holders fixedly or permanently attached to the belt. However, since no two people are alike or perform their tasks in exactly the same way, the preferred locations, sizes and shapes of the pouches and tool holders varies according to the person and the task at hand. Accordingly, there is a need for a tool belt that can be easily modified to suit the individual and the specific task.

Numerous tool bags and tool belts have been proposed that have removable or interchangeable pouches or tool holders. However, these tool bags offer only a limited range of adjustability, and pouches and tool holders can be easily knocked off of the belt, causing the nails, screws, bolts and/or tools to fall and possibly scatter. This is particularly a problem when a tradesperson is working at elevated levels, above other people.

The known tool belts have also exhibited disadvantages in the ways they add, remove or interchange pouches or object-receiving receptacles. Such receptacles have typically been permanently attached to the tool belts. When they have been removable, attaching or detaching them from the tool belt has been inconvenient, awkward and/or difficult, especially when the pouches or receptacles are large, bulky or heavy. With most tool belts, pouches are provided with loops through which the belts extend. With such tool belts, pouches or receptacles can only be removed by opening the belt and sliding that pouch off one or the other end of the belt. Examples of such tool belts are described in U.S. Design Pat. No. D302,489 and U.S. Pat. No. 4,923,105. Other patents disclose the use of various fasteners, such as snaps, hook and loop tape (e.g., "VELCRO"), hooks and the like. Such fasteners frequently make it to difficult, if not impossible, to detach the pouch, especially with only one hand while the other hand is occupied. The fasteners are typically behind the pouches: they must be released or forcibly separated or pulled apart, by pulling on a pouch in a direction substantially away from the user. These tool belts are neither designed nor intended to facilitate attachment, detachment or exchange of pouches while working or in difficult working environments such as on a ladder or crouching in a tight space.

SUMMARY OF THE INVENTION

Accordingly, is an object of the invention to provide a utility belt system that overcomes the disadvantages inherent in prior art tool belts.

It is another object of the invention to provide a utility belt system that is simple in construction and economical to manufacture.

It is still another object of the invention to provide a utility belt system that is easy and convenient to use.

It is yet another object of the invention to provide a utility belt system that is modular and can be a highly customized to the preferences or needs of the person using the belt.

It is still another object of the invention to provide a utility belt system that can be conveniently used because it allows the user to quickly and easily release a pouch or receptacle—by lifting same off the tool belt—with his or her fingers.

It is a further object of the invention to provide a utility belt system that allows pouches or receptacles supported thereby to be easily and conveniently separated and lifted off of the tool belt.

It is still a further object of the invention to provide a utility belt system in accordance with the previous objects that allows a user add, remove or exchange pouches or object receptacles with the same ease and convenience despite their size, shape or weight.

In order to achieve the above objects and others that will become evident to those skilled in the art a utility belt system for carrying a plurality of objects thereon in accordance with the present invention comprises an elongated strap for removably supporting a plurality of object receptacles and at least one such object receptacle. Attaching means is provided for removably attaching said at least one object receptacle to said elongated strap. Said attaching means includes a finger-gripping portion for facilitating simultaneous gripping of said at least one object receptacle and detachment by lifting of said at least one object receptacle in a generally upward direction with the fingers of the user. In accordance with a further feature of the invention, said attaching means includes a snap-lock that can be unlocked and released by the user with his or her fingers substantially simultaneously while gripping and lifting said at least one object receptacle.

BRIEF DESCRIPTION OF THE DRAWINGS

The features of the present invention are disclosed in the detailed description and in the drawings, in which.

Figure 6:
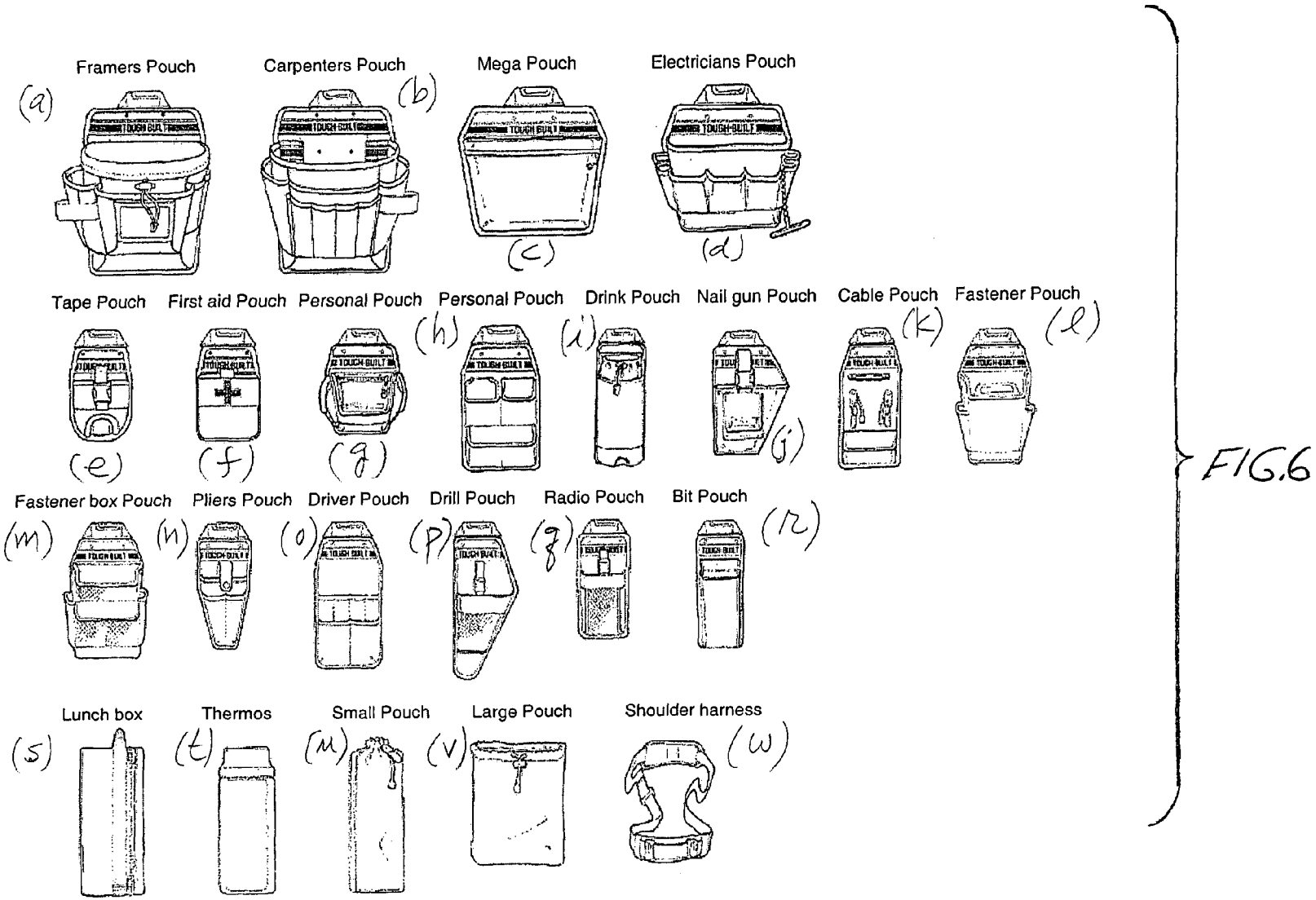
FIG. 6 illustrates, by way of example, a plurality of pouches and accessories that can be used with the utility belt system in accordance with the present invention.
Figure 7:
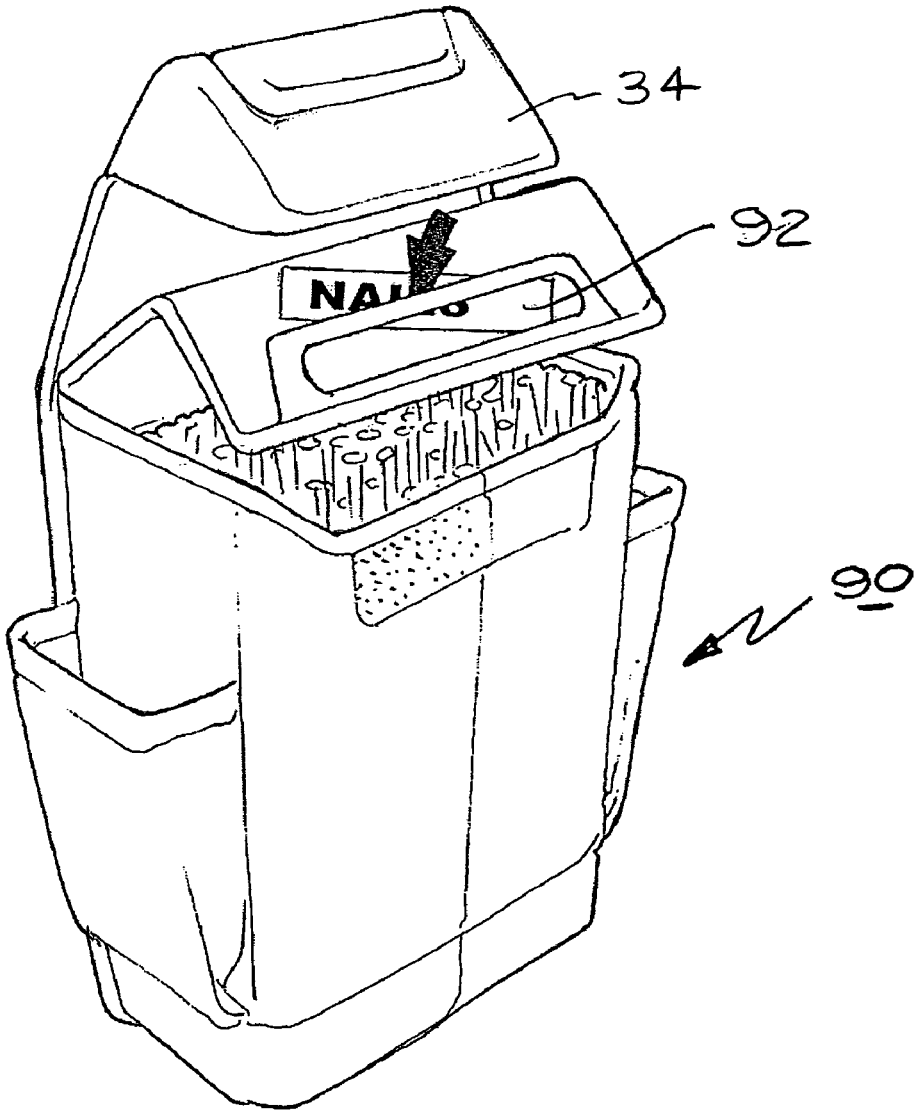

FIGS. **6*h* and 6*h*' are perspective views of a personal pouch or receptacle shown in FIG. 6**;

FIGS. is **6*k* and 6*k*'** are perspective views of a cable management system that can be used with the present invention;

FIG. **6*m*** is a perspective view of a pouch for use with a small fastener-organizer box;

FIG. **6*r*** is a perspective view of a bit-and-driver pouch;

FIG. 7 is a perspective view of a generic pouch with customizable tabs; and

Figure 8:
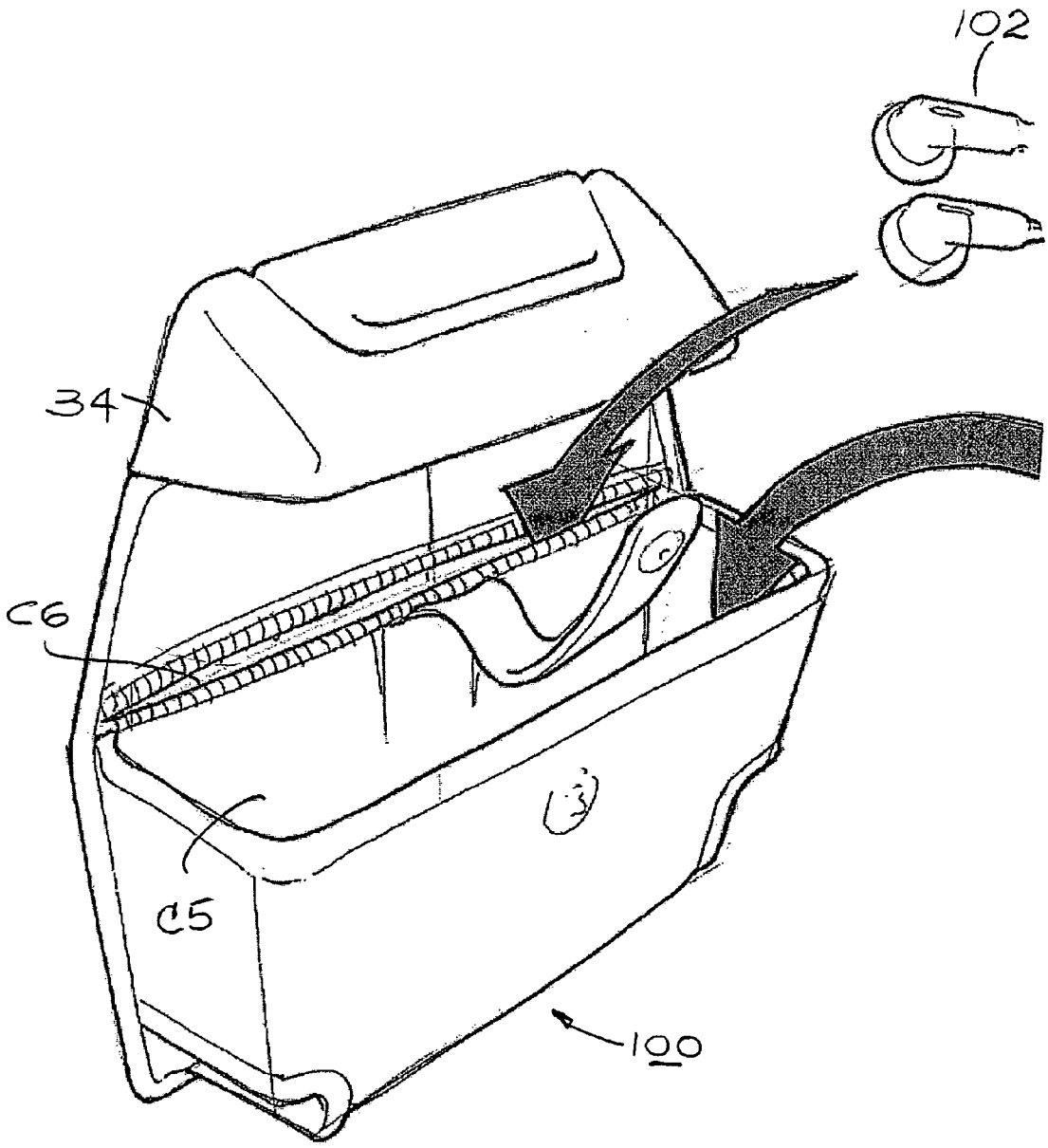

FIG. 8 is a perspective view of a personal entertainment device pouch.

Figure 9:
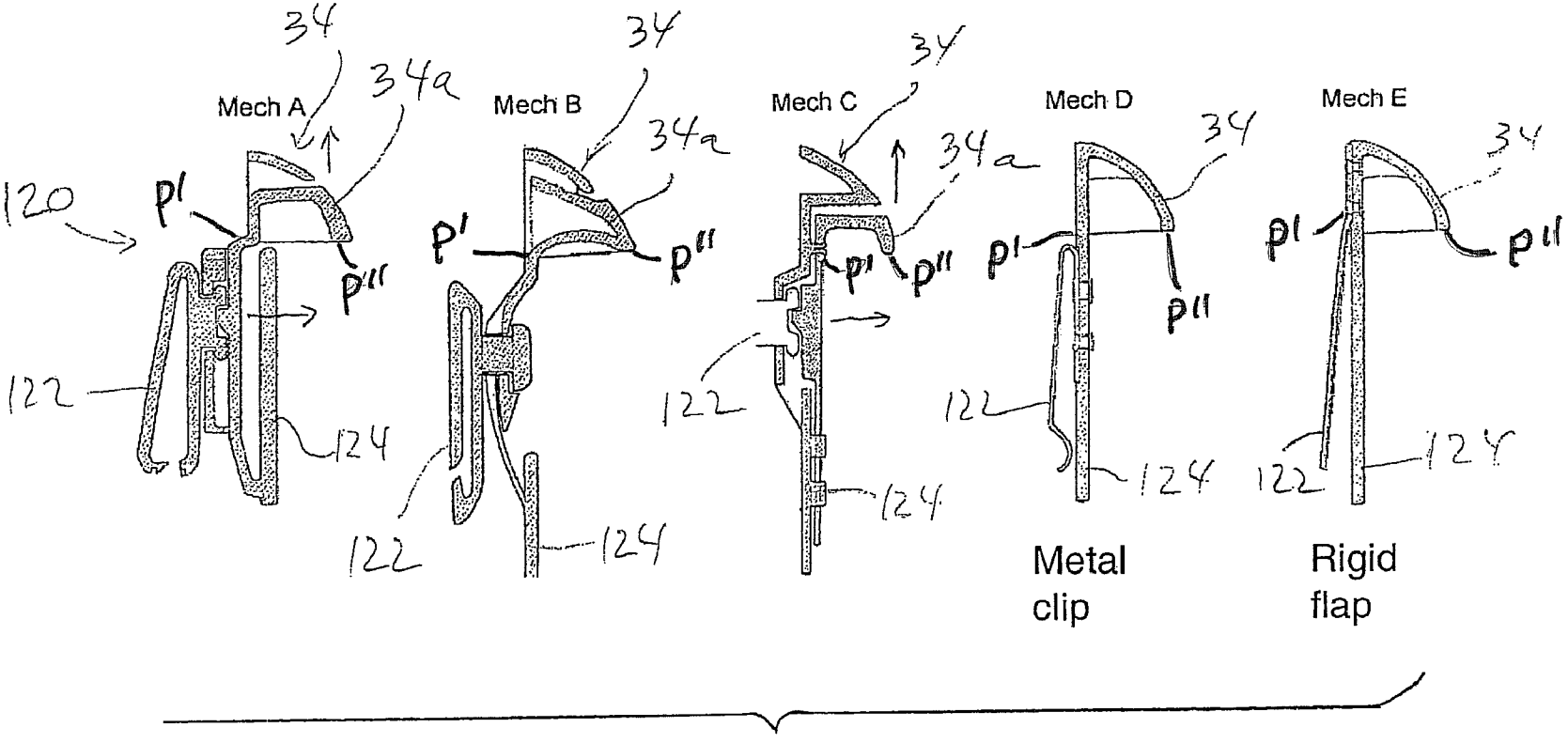

FIG. 9 are cross sections of sample clip mechanisms that can be used.

DESCRIPTION OF PREFERRED EMBODIMENTS

Figure 1:
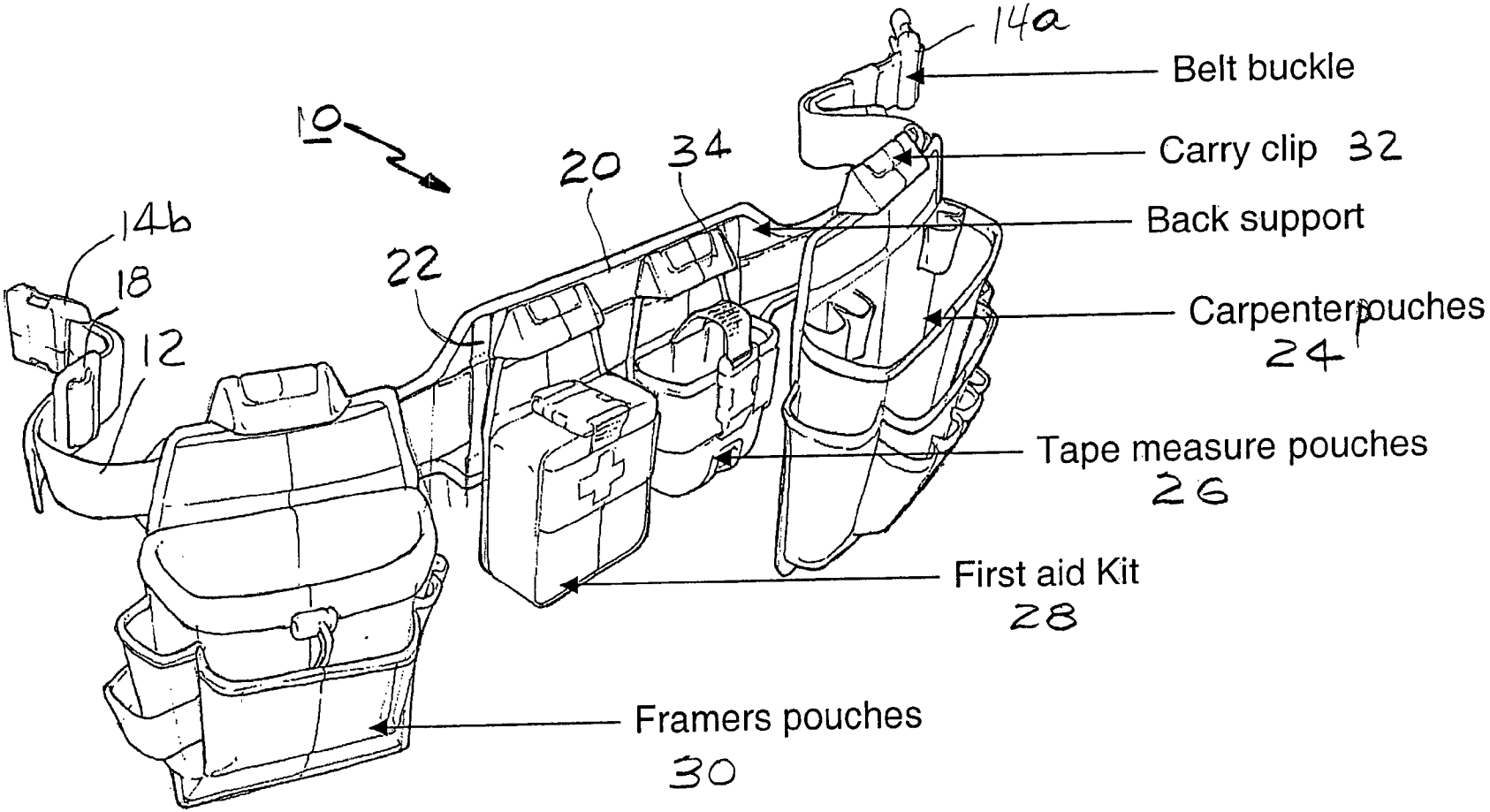
FIG. 1 is a perspective view of a utility belt system in accordance with the present invention, illustrating examples of a number of object receptacles or pouches supported on the modular tool belt.

Referring now to the Figures, in which similar or identical parts are identified by the same reference numerals throughout, and first referring to FIG. 1, a belt utility system in accordance with the present invention is generally identified by the reference 10.

The belt utility system 10 includes a generally flexible flat belt or strap 12 provided with mating male and female buckle members 14*a*, 14*b*. An adjustment member 18 may be provided for adjusting the overall length of the strap 12. A wider and stiffer back support member 20 may be attached to provide enhanced back support. The support member 20 may be attached to the strap 12 in any suitable manner: vertical or transverse straps 22 are used in the illustrative embodiment to form loops through which the belt or strap 12 extends. For reasons that will become evident, the back support 20 is arranged so that the belt or strap 12 remains substantially exposed facing outwardly while in the utility belt is worn by a user.

An important feature of the present invention is the manner in which a plurality of accessories, including tool and general object pouches or receptacles are attached to the belt or strap 12 to form a modular system that facilitates attachment, removal and exchange of object pouches or receptacles between users that employ or use the same utility belt systems.

In FIG. 1, each of the pouches, receptacles or accessories, including a carpenter's pouch 24, tape measure pouch 26, first-aid-kit pouch 28 and framer's pouch 30 is provided with a carrying clip 32 generally situated at the top of the respective pouch or accessories and generally aligned with or positioned above the upper edge of the belt or strap 12 when mounted thereon. The carrying clip 32 serves as an attaching means for removably attaching the object receptacle to the elongated strap or belt 12 and includes a finger gripping-portion 34 for facilitating simultaneous gripping of the object receptacle or pouch and detachment, with a generally lifting motion, of the object receptacle or pouch by lifting it with the fingers of the user.

Figure 2:
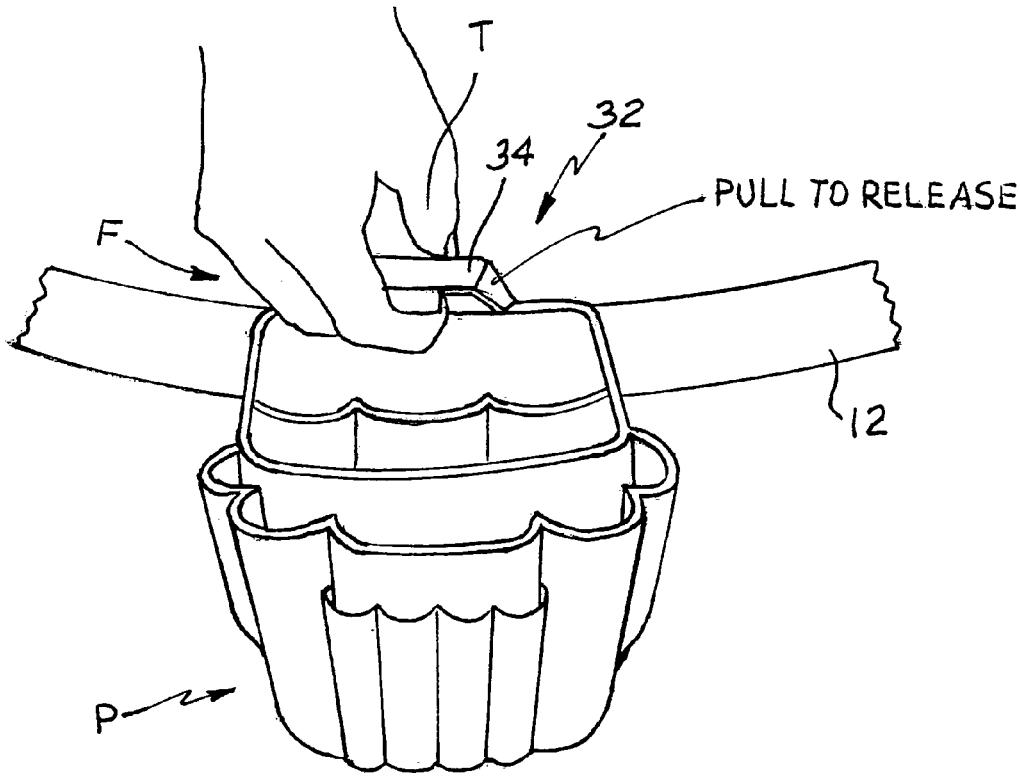
FIG. 2 illustrates the general manner of attaching an object receptacle or pouch to the belt in accordance with the invention.
Figure 6H:
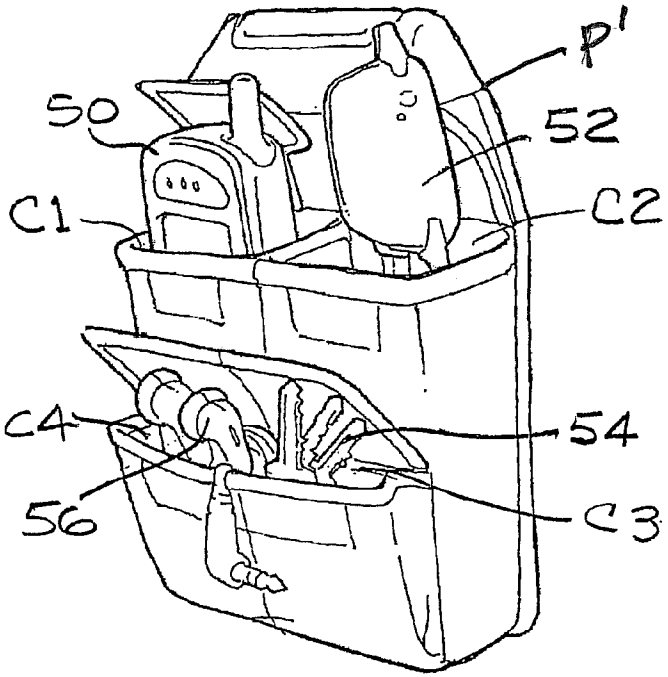
Figure 6H:
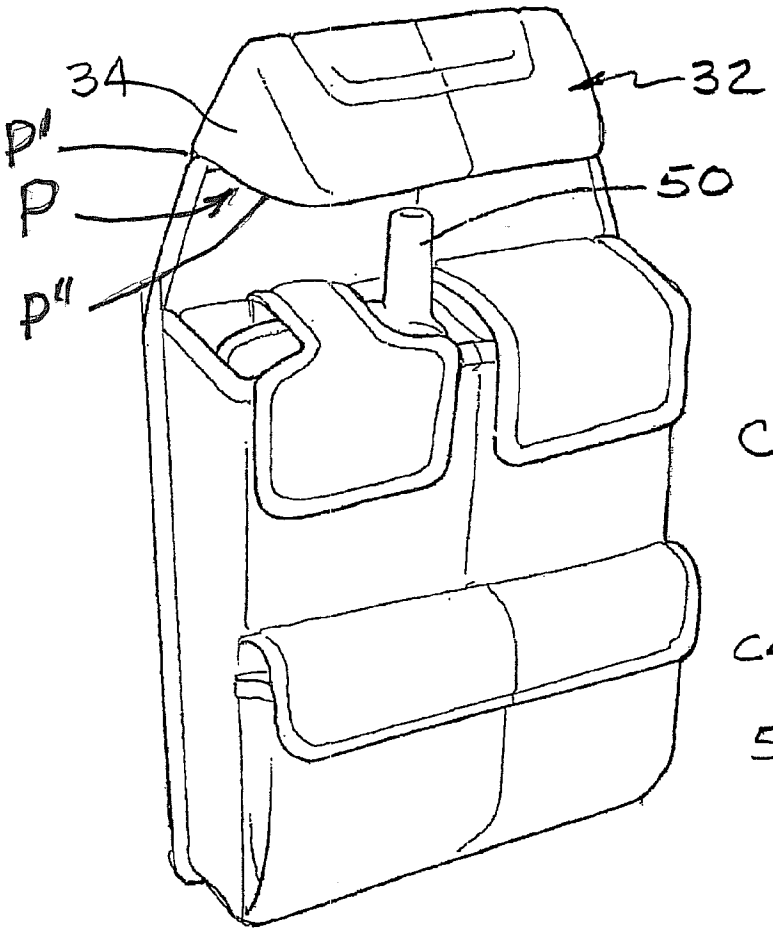
Figure 6K:
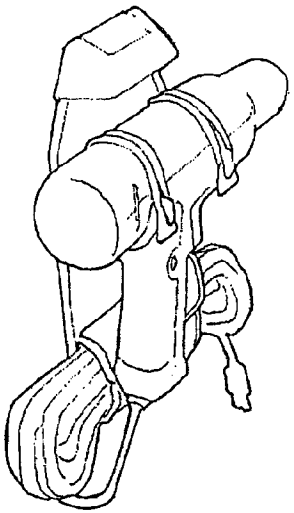
Figure 6K:
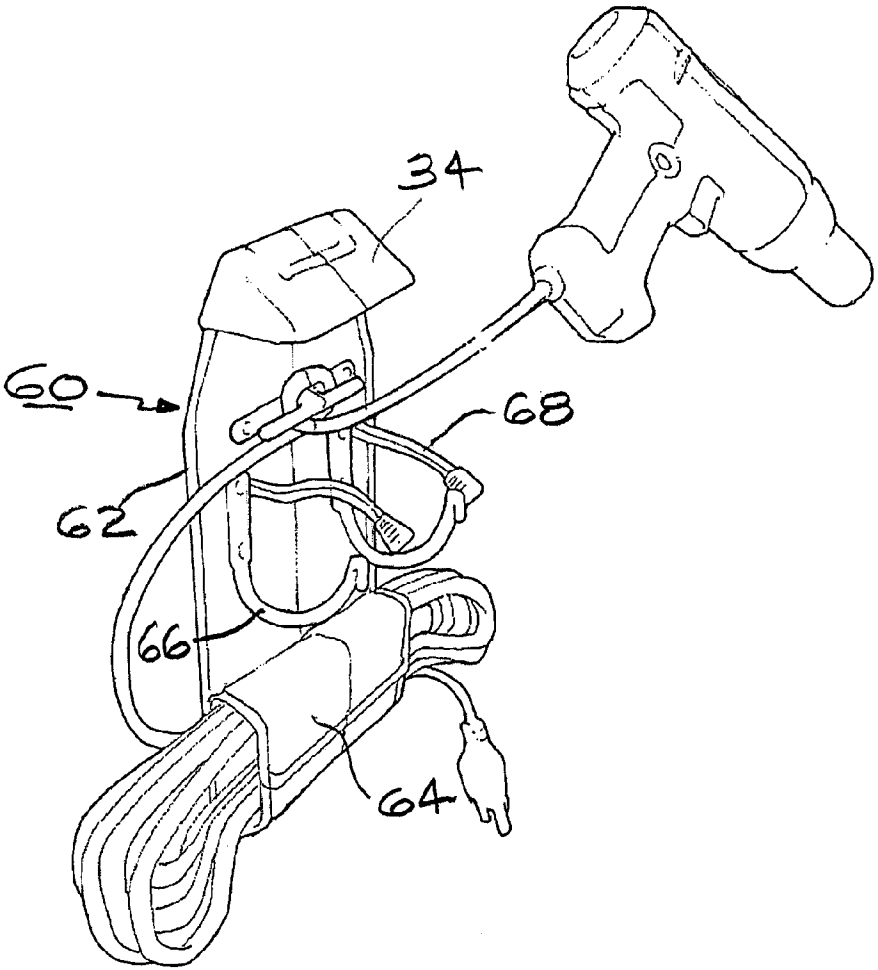
Figure 6M:
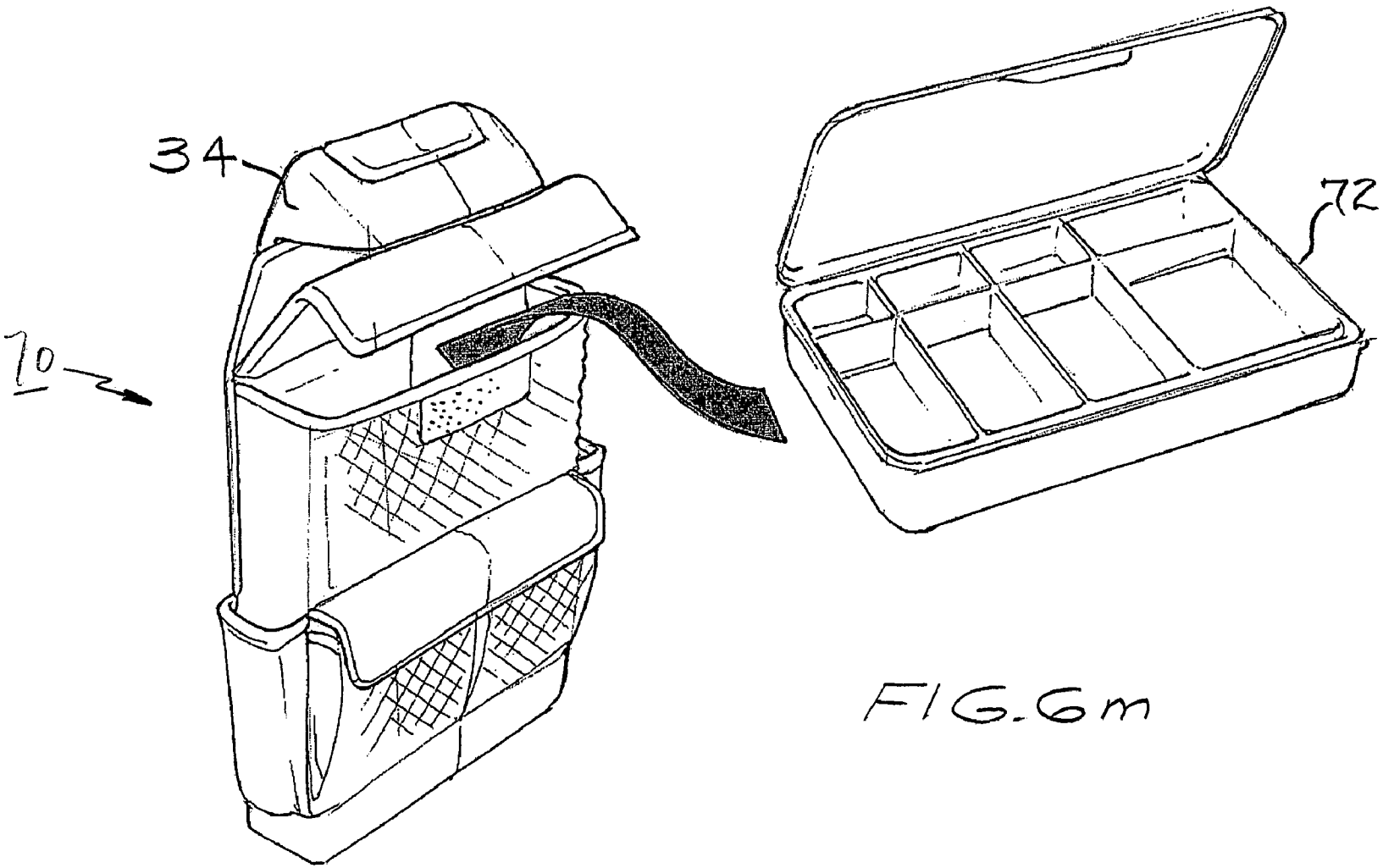
Figure 6R:
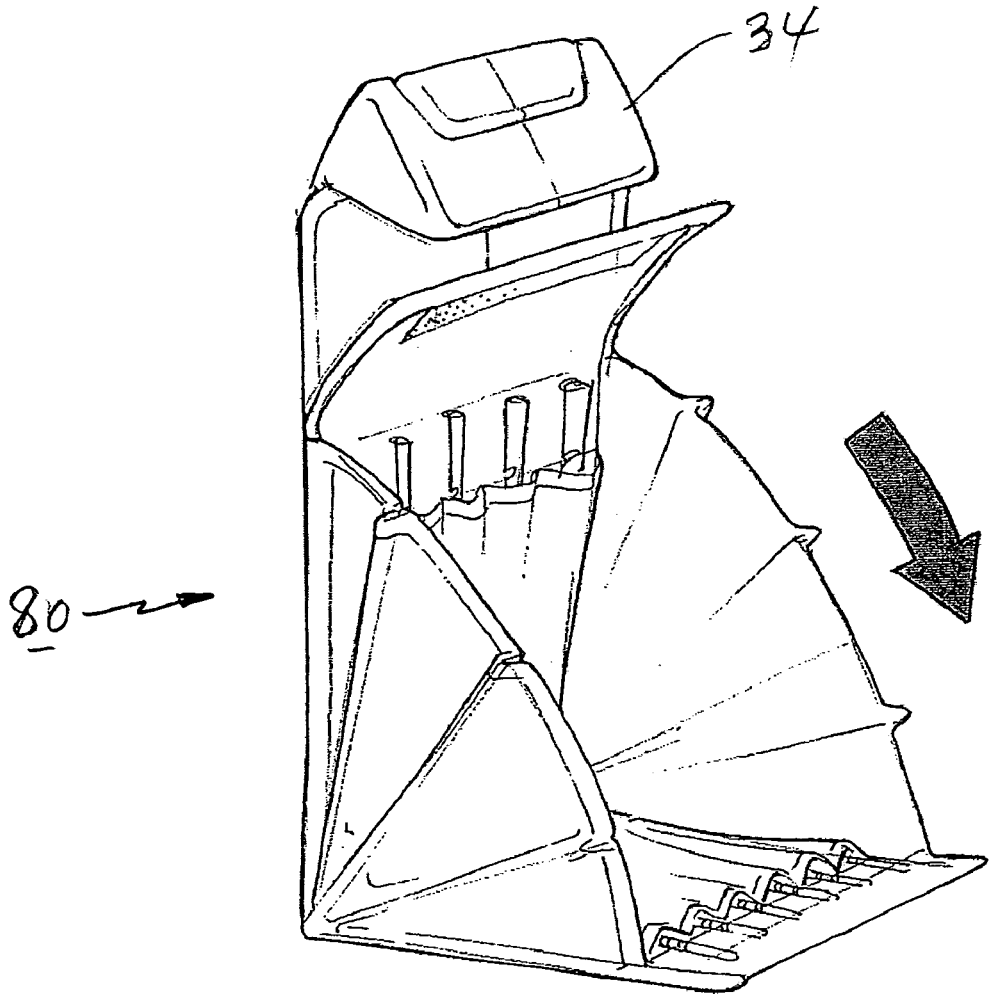

For this purpose, the finger-gripping portion includes a generally flat member that projects generally outwardly away from the belt or strap a distance sufficient to be engaged on its lower surface by the user's fingertips. Referring to FIGS. 6*h*, 6*h*' and 9, the member 34 that projects outwardly away from the belt defines a periphery P arranged in a substantially horizontal plane when normally mounted on the belt or strap 12, a portion P' of the periphery being connected to the receptacle while the remainder of the periphery P" is not connected to the receptacle and allows the fingers of the user to be placed under the projecting member by movement of the fingers past at least a portion of the periphery portion P" and under the projecting member. For this purpose the projecting flat member is preferably cupped downwardly facing a concave surface to prevent the user's fingers from slipping off the gripping portion 34 while supporting or lifting of the removable elements. This is generally illustrated in FIG. 2, in which the thumb T of the user is placed behind the finger gripping portion 34 while at least one or more of the user's remaining fingers are placed in front of and below the finger gripping portion 34 so that the carry clip 32 can be securely gripped and lifted from the belt or strap 12.

The present invention contemplates carry clips that both remain unlocked or can be locked to the belt or strap 12 during use, as more fully described in applicant's pending U.S. patent application Ser. No. 10/838,601, assigned to the assignee of the present application, which is fully incorporated by reference as if set forth herein. For purposes of the present invention, however, it is not critical whether the object pouches or receptacles or accessories are initially locked or unlocked from the belt or strap 12, as long as each is provided with a carrying clip that can be gripped by the user's fingers, as shown, easily and conveniently, and substantially independently of the size, shape or nature of the receptacle, pouch or accessory so that it can be attached to or separated from the belt or strap 12, or shared with other users who have a similar utility belt systems, at any stage or under any conditions of use.

Figure 3:
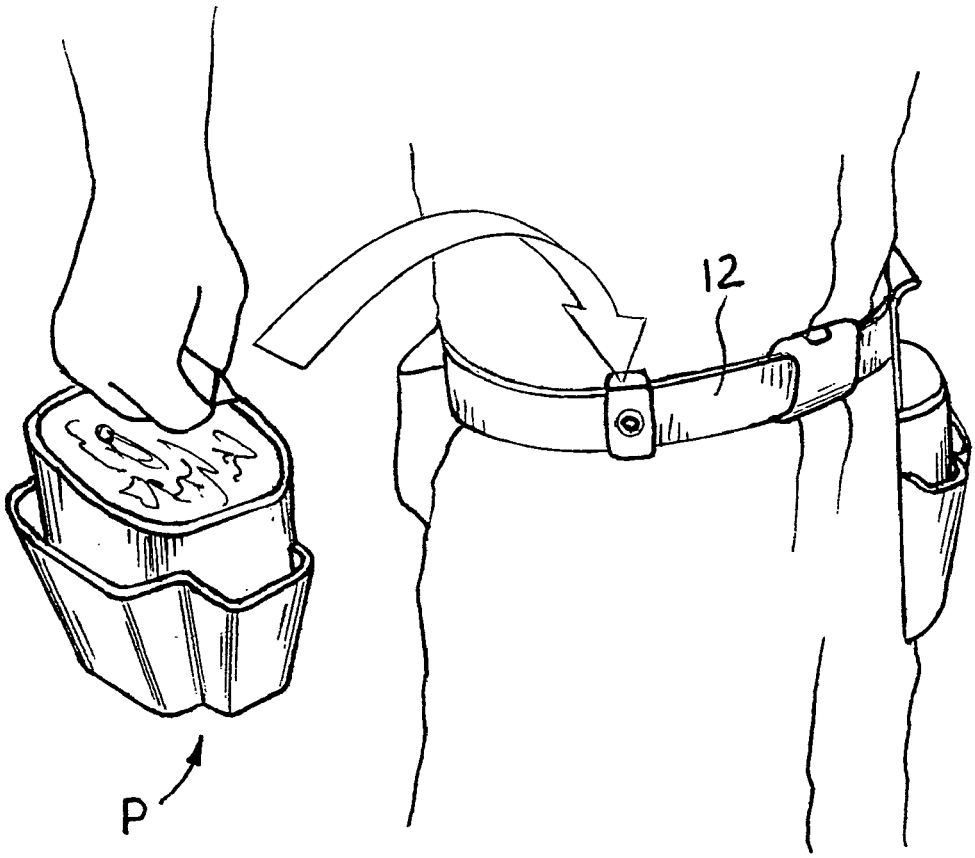
FIG. 3 illustrates the manner of holding an object receptacle or pouch and the general motion used in attaching it to the utility belt in accordance with the invention.
Figure 4:
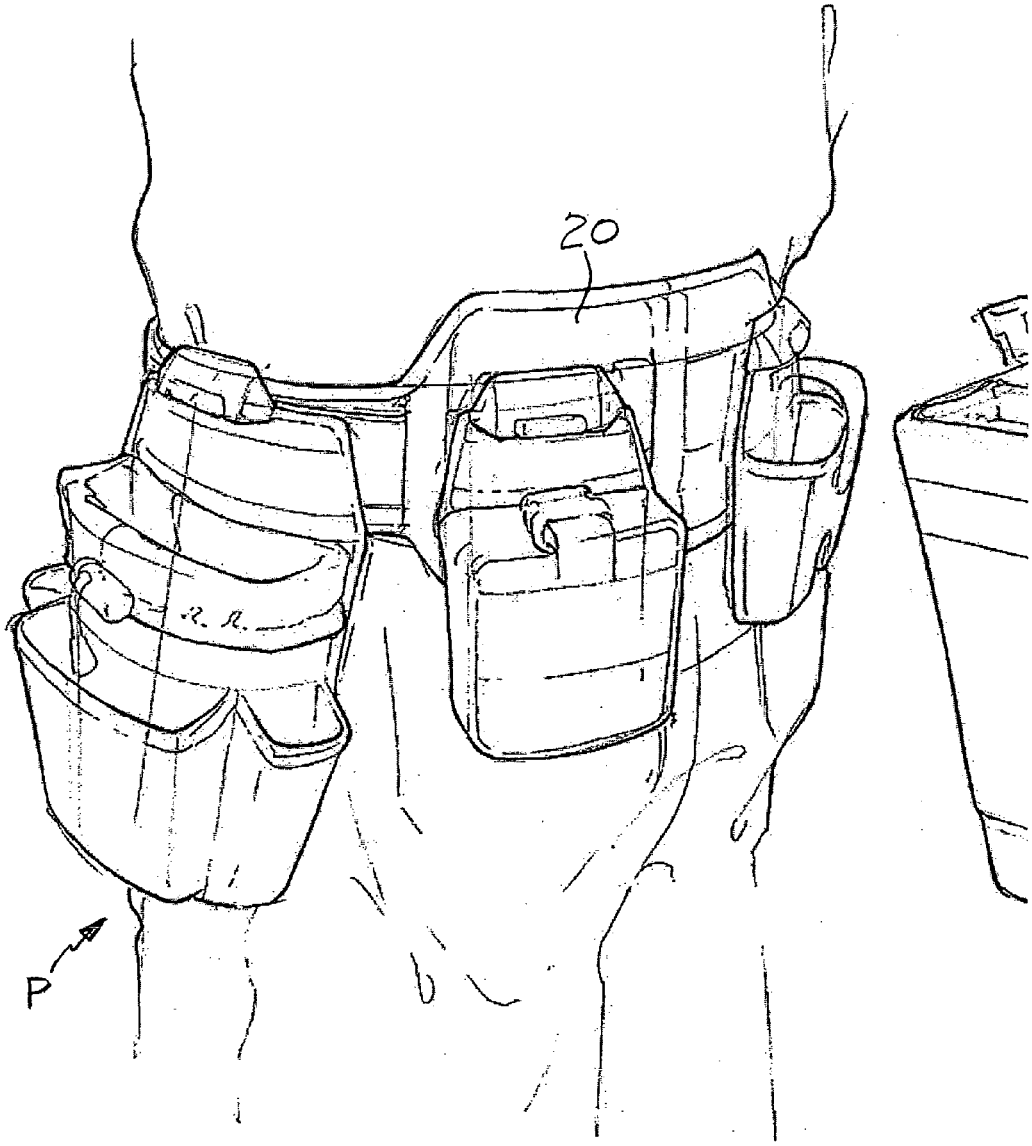
FIG. 4 is a perspective view illustrating the utility belt system with a plurality of object receptacles or pouches thereon as worn by a user.
Figure 5:
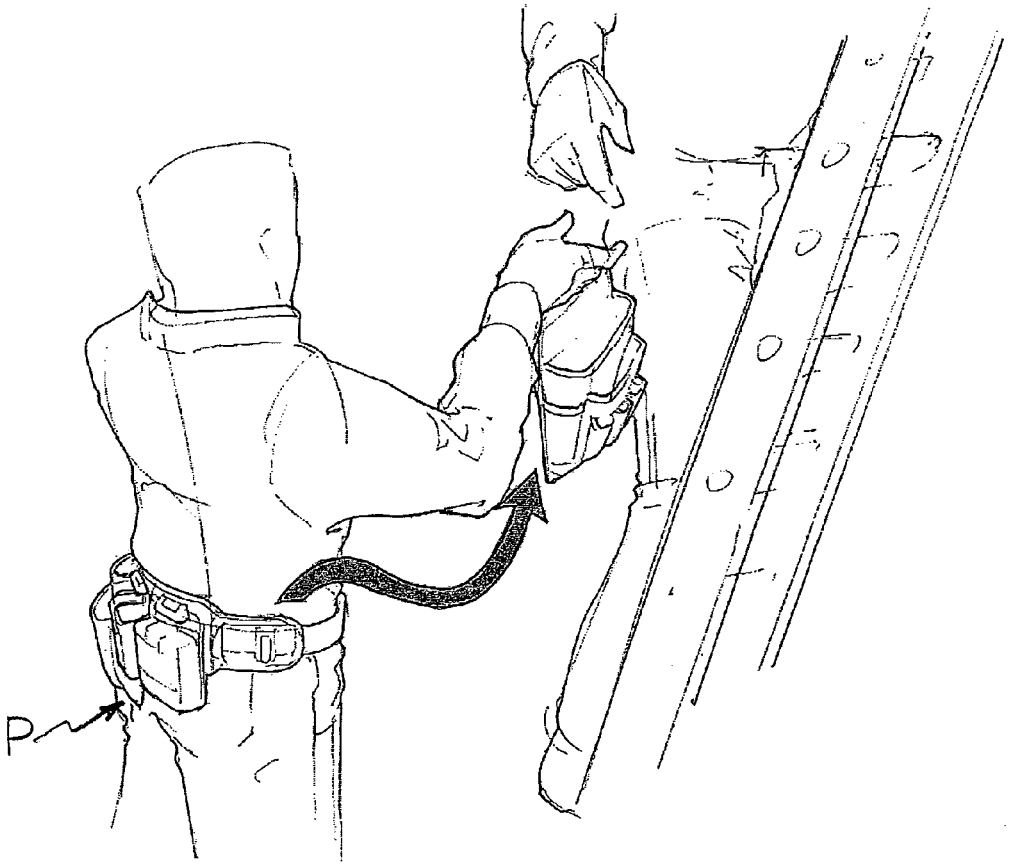
FIG. 5 illustrates the general motion by a user in removing an object receptacle or pouch from a utility belt and handing the same to another person for use or sharing thereof.

Referring to FIGS. 3 and 4, it will be evident that pouches or receptacles P can be as easily attached to or removed from the strap 12 whether the pouch is positioned in front of the user, as in FIG. 3, or in the back or rear of the user, as shown in FIG. 4. In FIG. 5 the user is shown handing a pouch or receptacle to another user after removing it from the user's belt by lifting the pouch or receptacle off the belt in the matter suggested.

In FIG. 6 a plurality of pouches or receptacles and accessories are illustrated that can be used with the utility belt system of the present invention. Insets [a]-[r] are examples of object pouches or receptacles that can be used with the utility belt system 10, each having a carry clip 32 of the type described situated in the top of the pouch, receptacle or accessory, in a position in which it can be easily and conveniently gripped by the user's fingers. Insets [s]-[w] illustrate accessories that can be used with the utility belt system 10 as well as with the various pouches or receptacles shown in the previous insets. In FIGS. 6*h* and 6*h*' a personal pouch is shown, by way of example, that includes a carrying clip 32 and finger-gripping portion 34. The pouch is provided with compartments C1-C4 for storing, for example, a cellular phone 50, glasses 52, keys 54 and earphones 56.

In FIG. 6(*k*), a cable management system 60 is shown that includes a substantially flat support body 62. The finger-gripping portion 34 is provided at the top of the support body 62, as it is with the other described pouches, receptacles or accessories. A flexible support brace 64, such as a VELCRO strap, can be attached to the support body for securing an electrical cable and shown. Spaced hooks 66, together with flexible bands or elastic loops 68, can be used to secure an electrical or power tool to the hooks 66.

In FIG. 6(*m*) another pouch 70 is illustrated especially adapted for receiving a small fastener-organizer box 72, as well as sundry other objects. As with the other pouches or receptacles, a finger-gripping portion 34 is provided at the top for easy and convenient gripping by a user and attachment or separation from the belt 12.

In FIG. 6(*r*) a bit and driver pouch 80 is shown, by way of a further example of a pouch or receptacle that can be used with the utility belt system of the present invention. As with the other pouches or receptacles for receiving various objects, here the pouch 80 is provided with a finger-gripping portion 34 at the top of the unit so that it can be easily and conveniently gripped whether it is positioned at the front or at the back of the user, and whether it is attached to or removed from the belt 12.

In FIG. 7 the details of still another pouch 90 is illustrated, by way of example, in the form of a generic pouch with customizable tabs 92. In this figure, the pouch is shown filled with nails, and a tab or label 92 marked "nails" is inserted into a window so that it is visible during use.

In FIG. 8 a still further example of a pouch or receptacle 100 in accordance with the invention is shown, one suitable for use with personal electronic devices, such as a radio or portable tape players. As with the other units, the receptacle 100 is provided with a finger-gripping portion 34 at the top for facilitating the gripping and lifting of the units with the user's fingers so as to mount or remove objects from the tool belt. Compartments C5 and C6 are suitable, for example, for the items of personal electronics (not shown) and earphones 102, respectively.

In FIG. 9 examples of cup mechanisms that can be used with the invention are illustrated. It will be evident to those skilled in the art that these specific clip mechanisms used are not critical, and that various clip mechanisms may be used to different degrees of advantage. The clip mechanisms illustrated in FIG. 9 are more specifically described in applicant's U.S. patent application Ser. No. 10/838,601. However, it will be evident that each clip mechanism must exhibit the following properties or features. It must include a finger-gripping portion 34 at the top thereof, for the reasons mentioned. A suitable attachment member such as a resilient finger, tab or flap 122 is provided for attachment to the belt or strap 12. The finger-gripping portion 34 is secured, directly or indirectly, to a portion 124 of the pouch, receptacle or accessory. The first three clip mechanisms A-C are locking-clip mechanisms in which portions 122 remain on the belt or strap 12 and portions 124 can be selectively attached or detached from the portions 122, typically by means of a snap-lock arrangement of any suitable or conventional type. With the first three shown clip mechanisms, pulling upwardly on the finger-gripping portions 34 has the additional effect of releasing the snap-lock mechanisms and allowing the pouches or receptacles to be separated and lifted away from the belt or strap 12. In the second two clip mechanisms D and E, the metal clip and rigid flap 122 remain permanently attached to the portion 124 and form part of the pouch or receptacle as does the finger-gripping portion 34. With the latter two clip mechanisms, the pouches or receptacles are not locked to the belt but can be removed by being lifted vertically. However, the clip mechanisms that lock include an additional releasing tab 34*a* that moves relative to the finger-gripping portion 34 to release the snap or locking connector so that the pouch or receptacle can be separated and a lifted from the belt 12 to which the permanently attached portions 122 continue to be secured.

It will be clear that the utility belt system 10 of the present invention is designed to make the daily tasks of carrying and using tools and other supplies easier, faster and customizable to individual needs. The system allows end-users to organize attachments according to their own preferences. Because objects and receptacles are secured to the belt by means of a snap lock, and because the finger-gripping portion includes a quick-release mechanism and/or button that allows the user to take off, attach, share, organize and carry the tools and supplies of their choice, as many or as few as desired, each end-user can build his or her own kind of utility belt. As many tools, supplies or accessories can be carried as are necessary to complement individual needs or habits. In sum, this provides end-users with the freedom to accomplish what they want to do, the way they want to do it. It allows each user to create a system that fits and supports his or her daily routine in an efficient and convenient way.

The utility belt system of the present invention provides advantages over existing tool belts in the marketplace. These prior art tool belts provide a very limited choice of arrangements and accessories, whereas the present invention accommodates the needs of tradespeople in a wide variety of trades, including construction, framing, carpentry, plumbing, electrical, finishing, auto-mechanics and many others.

The unique finger-gripping portions that form part of the carrying clip allow the end-user to lighten his or her load by removing pouches when these are no longer needed, or when the user is in a tight area or difficult spot. And when it is necessary to share tools or supplies, this is easily achieved with the present invention simply by taking off a given pouch or receptacle and handing it to a colleague—without undoing a belt and regardless of whether the pouch is in the front or back of the user. A simple lift of the finger-gripping portion 34 separates the pouch from the belt. When a snap-lock arrangement forms part of the carrying clip, the user can conveniently and easily apply pressure to an ergonomically positioned snap-releasing tab, button or portion, simultaneously unlocking the pouch and lifting and separating it from the belt. This is exceptionally convenient: the user can perform do all this in one single step using his or her fingers. Thus, this ergonomic unlocking motion is a natural and easy one.

The belt can be configured to retailers' customer base and their selling strategy. The target uses for this product are do-it-yourself (DIY), handyman, finishers, professional contractors, electricians, plumbers, craftsmen, auto-mechanics and many other tradesmen.

While this invention has been described in detail with particular reference to preferred embodiments thereof, it will be understood that variations and modifications will be effected within the spirit and scope of the invention as described herein and as defined in the appended claims.

What is claimed:

1. A belt utility system for carrying a plurality of objects thereon comprising: an elongated flexible belt for removably supporting a plurality of object receptacles; at least one object receptacle having an upper portion when supported on said belt; attaching means for removably attaching said at least one object receptacle to said belt, said attaching means including a lock comprising a first portion of which is on said elongated belt and a second portion of which is on said receptacle facing said belt; a finger-grip generally proximate to said upper portion of said at least one receptacle projecting in a direction away from said belt and a generally downwardly facing finger-gripping surface above said receptacle when said receptacle is supported on said belt, whereby said finger gripping surface is accessible for contacting by fingers of a user for allowing simultaneous gripping of said finger-grip by a plurality of fingers of the user and lifting by a generally upward motion to lift said at least one object receptacle and separate it from said belt when said lock portions are disengaged from each other; and a release member formed within and moveable relative said finger-grip and positioned to enable the fingers of a single hand to simultaneously engage both said gripping surface and said release member, whereby placement of a user's fingers of one hand under said gripping surface while actuating said release member with the same hand permits lifting said finger grip in a generally upward direction relative to said belt.

2. A belt utility system as defined in claim 1, wherein said downwardly-facing surface of said finger-grip is formed as a receiving recess below said finger-grip that faces downwardly in the direction of said at least one receptacle for receiving the user's finger tips and for helping to prevent the user's fingers from inadvertently slipping out during lifting or transporting of said at least one object receptacle.

3. A belt utility system as defined in claim 2, wherein said recess is dimensioned to receive at least the four finger tips of the user exclusive of the thumb.

4. A belt utility system as defined in claim 1, wherein said lock comprises a snap lock.

5. A belt utility system as defined in claim 1, wherein said object receptacle is selected from the group consisting of framer's pouch, carpenters pouch, electrician's pouch, tape pouch, first aid pouch, personal pouch, personal pouch, drink pouch, nail gun pouch, cable pouch, fastener pouch, fastener box pouch, pliers pouch, driver pouch, drill pouch, radio pouch, bit pouch, lunch box, thermos.

6. A belt utility system as defined in claim 1, wherein a plurality of said object receptacles are selected from the group consisting of framer's pouch, carpenters pouch, electrician's pouch, tape pouch, first aid pouch, personal pouch, personal pouch, drink pouch nail gun pouch, cable pouch, fastener pouch, fastener box pouch, pliers pouch, driver pouch, drill pouch, radio pouch, bit pouch, lunch box, thermos are supported on said belt.

7. A belt utility system for carrying a plurality of objects thereon comprising: an elongated flexible belt for removably supporting a plurality of objects; at least one object having an upper portion when supported on said belt; attaching means for removably attaching said at least one object to said belt, said attaching means including a snap lock connector a portion of which is on said elongated belt and a portion of which is on said object; a finger-gripping portion generally proximate to said upper portion of said at least one object having a generally downwardly facing finger griping surface and configured for allowing simultaneous gripping of said finger-gripping portion by a plurality of fingers of the user and lifted by a generally upward motion to lift said at least one object receptacle and separate it from said belt when said snap lock connector is actuated to disengage said snap lock portions from each other; and a releasing tab or button formed within said finger-gripping portion positioned for actuation by a user's single finger for releasing said snap lock connector portions from each other when pressed by the single finger of the user substantially simultaneously with a lifting motion of said finger-gripping portion by the user's remaining fingers positioned under said finger-gripping portion, whereby following release of said connector portions from each other by actuation of said releasing tab or button the user's remaining fingers can be used to substantially simultaneously lift said at least one receptacle and separate it from said belt, said releasing means comprising said release tab or button moveable relative to said finger-gripping portion.

8. A belt utility system as defined in claim 7, wherein said downwardly-facing surface of said finger-grip is formed as a receiving recess below said finger-grip that faces downwardly in the direction of said at least one receptacle for receiving the user's finger tips and for helping to prevent the user's fingers from inadvertently slipping out during lifting or transporting of said at least one object receptacle.

9. A belt utility system as defined in claim 8, wherein said recess is dimensioned to receive at least the four finger tips of the user exclusive of the thumb.

10. A belt utility system as defined in claim 7, wherein said object is selected from the group consisting of framer's pouch, carpenters pouch, electrician's pouch, tape pouch, first aid pouch, personal pouch, personal pouch, drink pouch, nail gun pouch, cable pouch, fastener pouch, fastener box pouch, pliers pouch, driver pouch, drill pouch, radio pouch, bit pouch, lunch box, thermos.

11. A belt utility system as defined in claim 7, wherein a plurality of said objects is selected from the group consisting of framer's pouch, carpenters pouch, electrician's pouch, tape pouch, first aid pouch, personal pouch, personal pouch, drink pouch nail gun pouch, cable pouch, fastener pouch, fastener box pouch, pliers pouch, driver pouch, drill pouch, radio pouch, bit pouch, lunch box, thermos are supported on said belt.

* * * * *